US012504189B2

(12) United States Patent
Alayil

(10) Patent No.: US 12,504,189 B2
(45) Date of Patent: Dec. 23, 2025

(54) REFRIGERANT LEAK DETECTION SYSTEM AND METHOD

(71) Applicant: Lennox Industries Inc., Richardson, TX (US)

(72) Inventor: Rajesh Alayil, Kerala (IN)

(73) Assignee: Lennox Industries Inc., Richardson, TX (US)

( * ) Notice: Subject to any disclaimer, the term of this patent is extended or adjusted under 35 U.S.C. 154(b) by 367 days.

(21) Appl. No.: 18/342,557

(22) Filed: Jun. 27, 2023

(65) Prior Publication Data

US 2025/0003614 A1 Jan. 2, 2025

(51) Int. Cl.

| | |
|---|---|
| ***F24F 11/36*** | (2018.01) |
| ***F24F 11/52*** | (2018.01) |
| ***F24F 11/89*** | (2018.01) |

(52) U.S. Cl.

CPC ..... *F24F 11/36* (2018.01); *F24F 11/52* (2018.01); *F24F 11/89* (2018.01)

(58) Field of Classification Search

CPC ..... F24F 11/36; F24F 11/52; F24F 11/89

See application file for complete search history.

(56) References Cited

U.S. PATENT DOCUMENTS

2021/0108820 A1* 4/2021 Hovardas ..... F24F 11/36
2022/0397297 A1* 12/2022 Foster ..... G01N 1/2247

* cited by examiner

*Primary Examiner* — Mark A Connolly
(74) *Attorney, Agent, or Firm* — Baker Botts L.L.P.

(57) ABSTRACT

A refrigeration system includes a tubing system, a sensor circuitry, a fan, and a controller. The tubing system has tubes located adjacent to component of the refrigeration system. The tubes have holes on their surface. The fan is downstream of the tubes. The fan pulls sampled air though the tubes and direct the sampled air toward the sensor circuitry. The controller receives a signal that indicates that the sampled air comprises a mixture of air and refrigerant particles. In response to receiving the signal, the controller determines that there is refrigerant leakage from at least one of the one or more components and triggers a mitigation plan associated with the refrigerant leakage.

20 Claims, 6 Drawing Sheets

REFRIGERANT LEAK DETECTION SYSTEM AND METHOD

TECHNICAL FIELD

The present disclosure relates generally to heating, ventilation, and air conditioning (HVAC) systems and methods of their use, and more specifically to refrigerant leak detection system and method.

BACKGROUND

Heating, ventilation, and air conditioning (HVAC) systems are used to regulate environmental conditions within an enclosed space. Typically, HVAC systems include an evaporator coil and a condenser coil. A blower of the HVAC system pulls warm air from the enclosed space and pushes the air across the evaporator coil to cool the air. A refrigerant may leak from a component of the HVAC system. It is challenging to detect refrigerant leakage.

SUMMARY

The system described in the present application provides several practical applications and technical advantages that overcome the current technical problems described herein. The following disclosure is particularly integrated into a practical application of improving the detection of refrigerant leakage within a refrigeration system.

In general, the refrigerant leak detection system improves the detection of refrigerant leakage from a component of a refrigeration system. Within the refrigeration system, refrigerant leakage may occur at any location and any component. For example, the refrigerant may leak from a component of the refrigeration system due to corrosion, loose joints, loose physical connections, loose screws, and loose junctions, among other reasons. In current approaches, to detect refrigerant leakage from a component of a refrigeration system, a sensor is placed at a location within the refrigeration system, where the sensor is configured to detect the refrigerant when the refrigerant comes in contact with the sensor or within a detection range of the sensor. However, these approaches suffer from several drawbacks. For example, if a sensor is far away from the location where the refrigerant leakage has occurred, it will take a long time for the refrigerant to reach the sensor. This leads to the leakage not being detected in a timely manner and therefore not being addressed or remedied. In one example, the refrigerant may leak from a component that is at one corner of the refrigeration system and the sensor is at the opposite corner of the refrigeration system. In such cases, the refrigerant may accumulate until it reaches the sensor so the sensor can detect the refrigerant accumulation as a result of leakage. This approach leads to a long detection time. In some cases, the refrigerant is mildly flammable or fully flammable, such as propane. Thus, the long delay in detecting the flammable refrigerant is dangerous and may lead to the refrigeration system catching flames if the accumulated refrigerant is not dispersed out of the refrigeration system 100 by a blower. One potential solution to address the slow detection of refrigerant leakage may be to use multiple sensors at different locations within the refrigeration system. However, this potential solution leads to an excessive number of sensors which incurs additional costs and is not feasible to implement in large refrigeration systems, where maybe tens of sensors may be needed to disperse at different locations within the refrigeration system.

This disclosure contemplates an unconventional refrigerant leak detection system and method that actively detect refrigerant leakage throughout the refrigeration system as opposed to the current techniques where the system waits until the refrigerant passively reaches the sensor. In the disclosed system, a set of tubes are positioned within the interior of the refrigeration system. Each tube has holes on its surface to allow airflow to the interior of the tube. The fan may be located at the edge of a tube. The sensor is located downstream of the fan. When the fan is switched on, it pulls the air from the inside of the tubes toward the sensor. The air from the inside of the tubes may include sampled air from the holes on the surface of the tubes. If there is a refrigerant leakage, air that is mixed with refrigerant particles is pulled into a hole in the tube. This causes the sampled air (the mixture of the refrigerant particles and air) to be pulled toward the sensor. Therefore, the sensor can detect refrigerant leakage faster than conventional methods.

In this manner, the refrigerant leak detection system improves the detection of refrigerant leakage from a component of the refrigeration system by detecting the leakage faster than the conventional techniques, reducing the response time in detecting the leakage and reducing the number of sensors required to detect leakage throughout the refrigeration system. For example, because the tubes of the tubing system run though out the refrigeration system and draw air from different locations within the refrigeration system, there is no need to deploy multiple sensors within the refrigeration system.

Furthermore, in case water or other liquid droplets (as the result of defrost) accumulate within the refrigeration system (e.g., as the result of defrost), the droplets will be dispersed or spread out inside the tubes and will not reach the sensor. Thus, the sensor is not damaged by the droplets. Thus, in this manner, the refrigerant leak detection system improves the detection of refrigerant leakage from a component of the refrigeration system by reducing the amount of water or other liquid droplets that are formed after defrost operation, where the droplets can reach the sensor and degrade the sensor.

Accordingly, the disclosed system provides a practical application of improving the refrigerant leak detection by 1) reducing the refrigerant detection time and, therefore, the response time irrespective of the location of the leakage and the distance of the location of the leakage to the sensor compared to the current detection techniques; 2) reducing the number of sensor requirements for the refrigerant leak detection systems, especially in large refrigeration systems; 3) reducing the degradation to the sensors that occur due to water or other droplets that are typically carried to the sensors after defrost operations; and 4) initiating mitigation plans to address and remedy the refrigerant leakage faster than the current techniques, where the mitigation plans include switching on the blower of the refrigeration system, communicating an alert message that indicates the refrigerant leakage is detected, among others.

In certain embodiments, a refrigeration system comprises a tubing system, a sensor, a fan, and a controller. The tubing system comprises one or more tubes. The one or more tubes is located adjacent to one or more components of the refrigeration system. The sensor circuitry is configured to detect refrigerant. The fan is located downstream of the one or more tubes. The fan is configured to pull sampled air through the tubing system and direct the sampled air toward the sensor circuitry, wherein the fan is further located upstream of the sensor circuitry. The controller is operably coupled with the sensor circuitry and configured to receive, from the sensor circuitry, a signal that indicates that the sampled air comprises a mixture of air and refrigerant particles. The controller is further configured to determine that there is refrigerant leakage from at least one of the one or more components and trigger a mitigation plan associated with the refrigerant leakage in response to receiving the signal.

Certain embodiments of this disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

As described above, previous technologies fail to provide an efficient, secure, and reliable solution for refrigerant leak detection, for example, in Heating, Ventilation, and Air Conditioning (HVAC) systems. Embodiments of the present disclosure and its advantages may be understood by referring to FIGS. 1 through 8. FIGS. 1 through 8 are used to describe systems and methods for refrigerant leak detection.

System Overview

Figure 1:
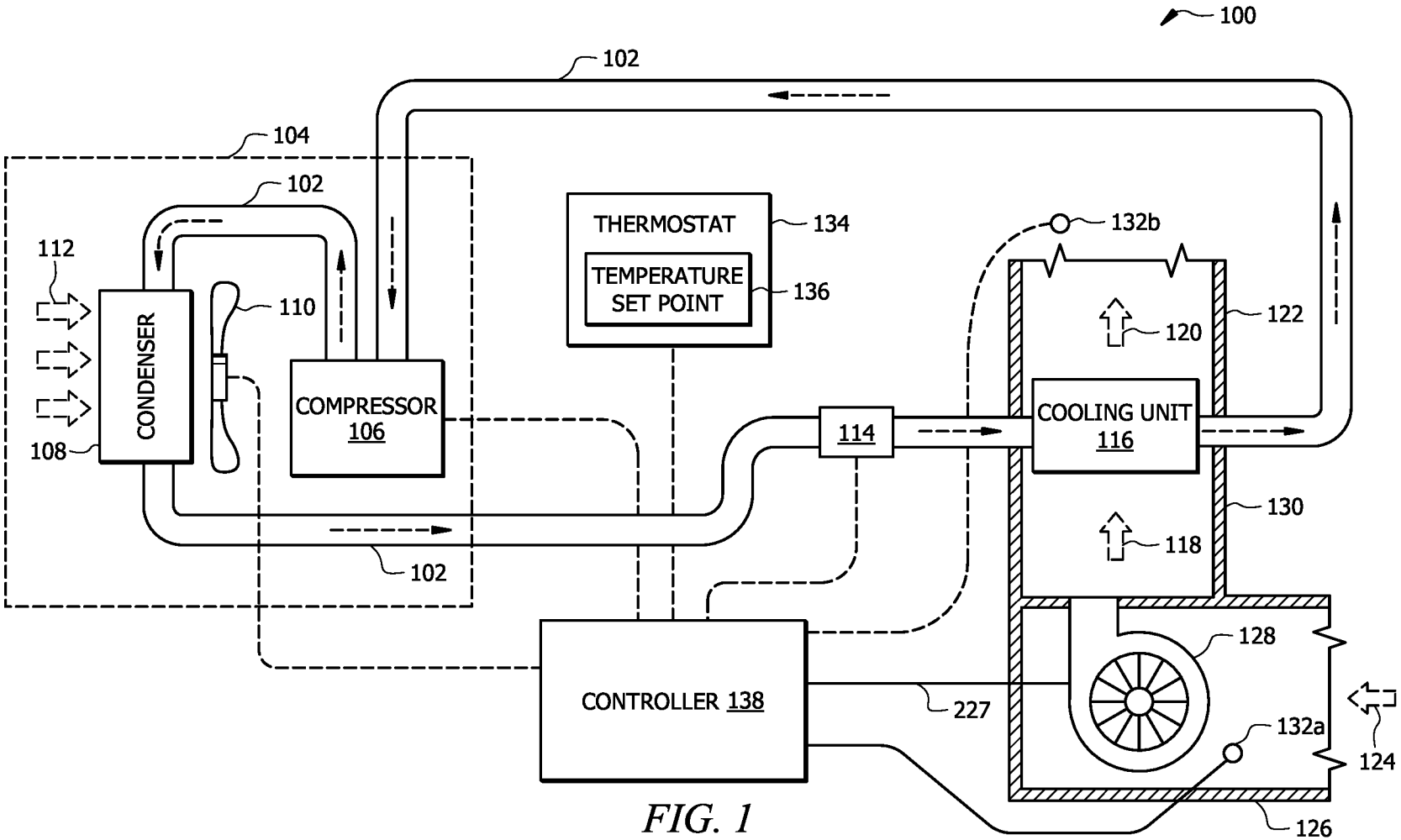
FIG. 1 illustrates a diagram of an example HVAC system.

FIG. 1 illustrates a schematic diagram of an embodiment of an HVAC system 100. The HVAC system 100 conditions air for delivery to a conditioned space. Various components of the HVAC system 100 may be motor-driven components including, but not limited to, the compressor 106, the fan 110, and the blower 128, described in greater detail below. The conditioned space may be, for example, a room, a house, an office building, a warehouse, or the like. In some embodiments, the HVAC system 100 is a rooftop unit (RTU) that is positioned on the roof of a building and the conditioned air is delivered to the interior of the building. In other embodiments, portion(s) of the system may be located within the building and portion(s) outside the building. The HVAC system 100 may also include heating elements that are not shown here for convenience and clarity. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, a condensing unit 104, an expansion valve 114, a cooling unit 116, a thermostat 134, and a controller 138. The working fluid conduit subsystem 102 facilitates the movement of a working fluid (e.g., a refrigerant) through a cooling cycle such that the working fluid flows as illustrated by the dashed arrows in FIG. 1. The working fluid may be any acceptable working fluid including, but not limited to, fluorocarbons (e.g., chlorofluorocarbons), ammonia, non-halogenated hydrocarbons (e.g., propane), hydroflurocarbons (e.g., R-410A), or any other suitable type of refrigerant.

The condensing unit 104 includes a compressor 106, a condenser 108, and a fan 110. The compressor 106 is coupled to the working-fluid conduit subsystem 102 and compresses (i.e., increases the pressure of) the working fluid. The compressor 106 of condensing unit 104 may be a variable speed or multi-stage compressor. A variable speed compressor is generally configured to operate at different speeds to increase the pressure of the working fluid to keep the working fluid moving along the working-fluid conduit subsystem 102. In the variable speed compressor configuration, the speed of compressor 106 can be modified to adjust the cooling capacity of the HVAC system 100. Meanwhile, a multi-stage compressor may include multiple compressors, each configured to operate at a constant speed to increase the pressure of the working fluid to keep the working fluid moving along the working-fluid conduit subsystem 102. In the multi-stage compressor configuration, one or more compressors can be turned on or off to adjust the cooling capacity of the HVAC system 100.

The compressor 106 is in signal communication with the controller 138 using a wired or wireless connection. The controller 138 provides commands or signals to control the operation of the compressor 106. For example, the controller 138 may operate the compressor 106 in different modes corresponding to load conditions (e.g., the amount of cooling or heating required by the HVAC system 100). As described in greater detail with respect to FIG. 2 below, the compressor 106 may be a motor-driven component. Accordingly, the controller 138 may provide a signal to a motor-drive circuit which powers a motor associated with the compressor 106. The controller 138 is described in greater detail below with respect to FIG. 2.

The condenser 108 is generally located downstream of the compressor 106 and is configured to remove heat from the working fluid. The fan 110 is configured to move air 112 across the condenser 108. For example, the fan 110 may be configured to blow outside air through the condenser 108 to help cool the working fluid flowing therethrough. The fan 110 may be in signal communication with the controller 138 using a wired or wireless connection such that the controller 138 provides commands or signals to control the operation of the fan 110. The fan 110 may be a motor-driven component. The controller 138 may provide a signal to a motor-drive circuit which powers a motor associated with the fan 110. The cooled working fluid from the condenser 108 flows toward an expansion valve 114.

The expansion valve 114 is coupled to the working-fluid conduit subsystem 102 downstream of the condenser 108 and is configured to remove pressure from the working fluid. In this way, the working fluid is delivered to the cooling unit 116 and receives heat from airflow 118 to produce a conditioned airflow 120 that is delivered by a duct subsystem 122 to the conditioned space. In general, the expansion valve 114 may be a valve such as an expansion valve or a flow control valve (e.g., a thermostatic expansion valve (TXV) valve) or any other suitable valve for removing pressure from the working fluid while, optionally, providing control of the rate of flow of the working fluid. The expansion valve 114 may be in communication with the controller 138 (e.g., via wired and/or wireless communication) to receive control signals for opening and/or closing associated valves.

The cooling unit 116 is generally any heat exchanger configured to provide heat transfer between air flowing through the cooling unit 116 (i.e., contacting an outer surface of one or more evaporator coils associated with the cooling unit 116) and working fluid passing through the interior of the cooling unit 116. The cooling unit 116 is fluidically connected to the compressor 106, such that working fluid generally flows from the cooling unit 116 to the compressor 106.

A portion of the HVAC system 100 is configured to move air 118 across the cooling unit 116 and out of the duct sub-system 122 as conditioned air 120. Return air 124, which may be air returning from the building, fresh air from outside, or some combination, is pulled into a return duct 126. A suction side of the blower 128 pulls the return air 124 through the duct 126. The blower 128 discharges airflow 118 into a duct 130 from where the airflow 118 crosses the cooling unit 116 or heating elements (not shown) to produce the conditioned airflow 120. The blower 128 is any mechanism for providing a flow of air through the HVAC system 100. For example, the blower 128 may be a constant-speed or variable-speed circulation blower or fan. Examples of a variable-speed blower include, but are not limited to, belt-drive blowers controlled by inverters, direct-drive blowers with electronic commuted motors (ECM), or any other suitable types of blowers.

The blower 128 is in signal communication with the controller 138 using any suitable type of wired or wireless connection. The controller 138 is configured to provide commands or signals to the blower 128 to control its operation. The blower 128 may be a motor-driven component. The controller 138 may provide a signal to a motor-drive circuit which powers a motor associated with the blower 128.

The HVAC system 100 generally includes one or more sensors 132*a,b* in signal communication with the controller 138. The sensors 132*a,b* may include any suitable type of sensor for measuring air temperature as well as other properties of a conditioned space (e.g., a room or building). The sensors 132*a,b* may be positioned anywhere within the conditioned space, the HVAC system 100, and/or the surrounding environment. For example, as shown in the illustrative example of FIG. 1, the HVAC system 100 may include a sensor 132*a* positioned and configured to measure a return air temperature (e.g., of airflow 124) and a sensor 132*b* positioned and configured to measure a supply or treated air temperature (e.g., of airflow 120). In other examples, the HVAC system 100 may include sensors positioned and configured to measure any other suitable type of air temperature (e.g., the temperature of air at one or more locations within the conditioned space and/or an outdoor air temperature).

The HVAC system 100 includes one or more thermostats 134, for example, located within the conditioned space (e.g., a room or building). The thermostat 134 is generally in signal communication with the controller 138 using any suitable type of wired or wireless communications. The thermostat 134 may be a single-stage thermostat, a multi-stage thermostat, or any suitable type of thermostat as would be appreciated by one of ordinary skill in the art. The thermostat 134 is configured to allow a user to input a desired temperature via a temperature setpoint 136 for a designated space or zone such as a room in the conditioned space. The controller 138 may use information from the thermostat 134 such as the temperature setpoint 136 for controlling the compressor 106, the fan 110, and/or the blower 128.

As described above, in certain embodiments, connections between various components of the HVAC system 100 are wired. For example, conventional cable and contacts may be used to couple the controller 138 to the various components of the HVAC system 100, including, the compressor 106, the fan 110, the expansion valve 114, the blower 128, sensor(s) 132, and thermostat 134. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 138 to other components of the HVAC system 100.

Example Refrigerant Leak Detection System

Figure 2:
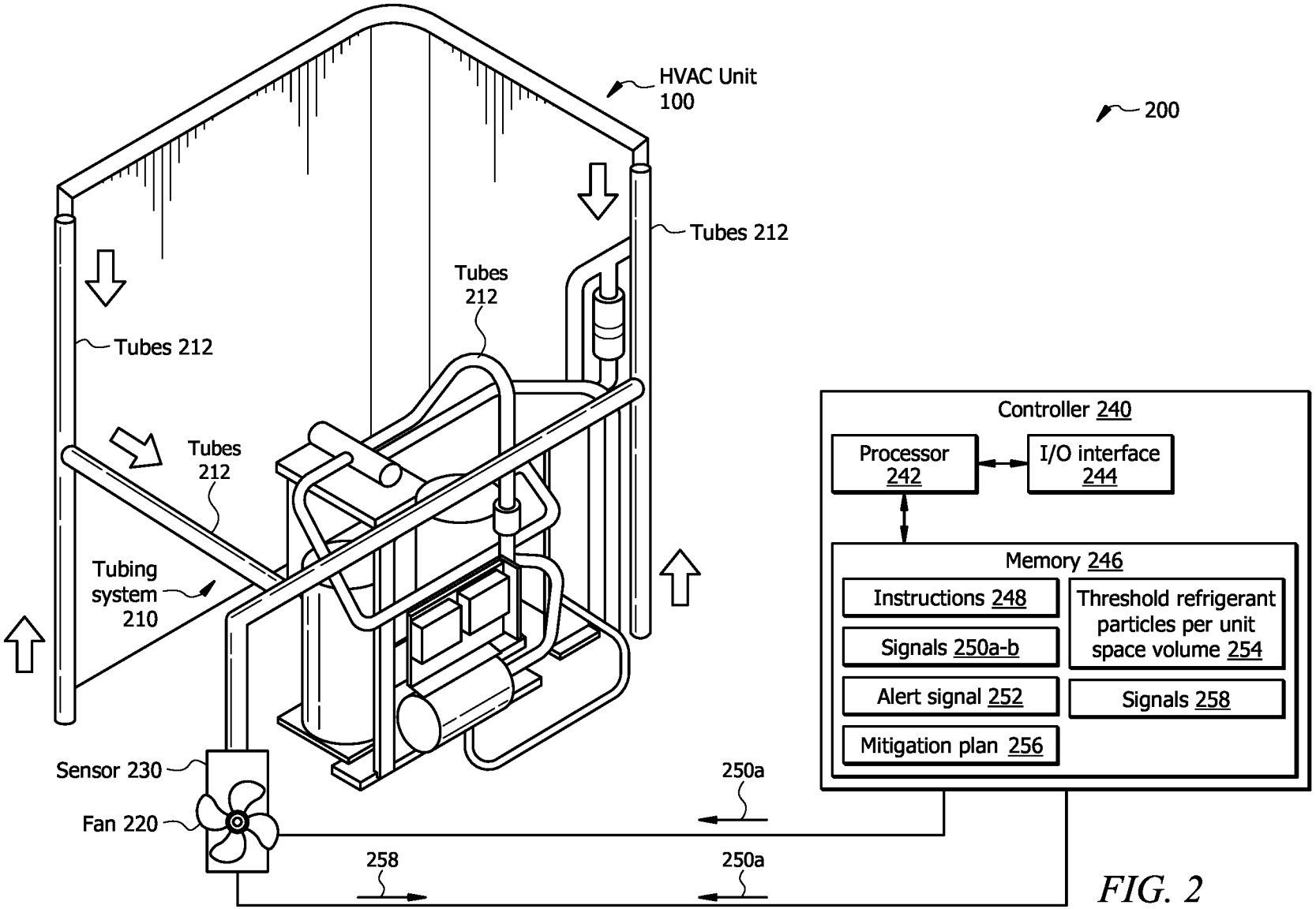
FIG. 2 illustrates a diagram of an example system configured to detect refrigerant leak in the HVAC system of FIG. 1.

FIG. 2 illustrates an example embodiment of a refrigerant leak detection system 200. In certain embodiments, the system 200 comprises a tubing system 210, a fan 220, a sensor 230, and a controller 240. The controller 240 is in signal communication with each of the fan 220 and sensor 230 via wires or wirelessly. The fan 220 and sensor 230 may be associated with and installed at tube 212 of the tubing system 210. In some embodiments, the refrigerant leak detection system 200 may be installed or deployed on a refrigeration system, such as the refrigeration system 100 of FIG. 1. In some embodiments, the refrigerant leak detection system 200 may be installed or deployed on any refrigeration system, such as chillers, HVAC units, and the like. In embodiments where the refrigerant leak detection system 200 is installed on the refrigeration system 100, the refrigeration system 100 may include the refrigerant leak detection system 200.

In general, the refrigerant leak detection system 200 improves the detection of refrigerant leakage from a component of the refrigeration system 100 (e.g., any of conduit subsystem 102, condensing unit 104, expansion valve 114, cooling unit 116, thermostat 134, etc.). In one example, the refrigerant leak detection system 200 improves the detection of refrigerant leakage from a component of the refrigeration system 100 by detecting the leakage faster than the conventional techniques and reducing the response time in detecting the leakage. In another example, the refrigerant leak detection system 200 improves the detection of refrigerant leakage from a component of the refrigeration system 100 by reducing the number of sensors required to detect leakage throughout the refrigeration system 100. In another example, the refrigerant leak detection system 200 improves the detection of refrigerant leakage from a component of the refrigeration system 100 by reducing the amount of water or other liquid droplets that form after defrost operation, where the droplets can reach the sensor and degrade the sensor.

Within the refrigeration system 100, refrigerant leakage may occur at any location and any component. For example, refrigerant may leak from a component of the refrigeration system 100 due to corrosion, loose joints, loose physical connections, loose screws, and loose junctions, among other reasons. In current approaches, to detect refrigerant leakage from a component of a refrigeration system 100, a sensor is placed at a location within the refrigeration system 100, where the sensor is configured to detect the refrigerant when the refrigerant comes in contact with the sensor or within a detection range of the sensor. However, these approaches suffer from several drawbacks. For example, if a sensor is far away from the location where the refrigerant leakage has occurred, it will take a long time for the refrigerant to reach the sensor. This leads to the leakage not being detected in a timely manner and therefore not being addressed or remedied. In one example, the refrigerant may leak from a component that is at one corner of the refrigeration system 100, and the sensor is at the opposite corner of the refrigeration system 100. In such cases, the refrigerant may accumulate until it reaches the sensor so the sensor can detect the refrigerant accumulation as a result of leakage. This approach leads to a long detection time. In some cases, the refrigerant is at least partially flammable or fully flammable, such as propane. Thus, the long delay in detecting the flammable refrigerant is dangerous and may lead to the refrigeration system catching flames if the accumulated refrigerant is not dispersed out of the refrigeration system 100 by the blower 128 (see FIG. 1). One potential solution to address the slow detection of refrigerant leakage may be to use multiple sensors at different locations within the refrigeration system 100. However, this potential solution leads to an excessive number of sensors which incurs additional costs and is not feasible to implement in large refrigeration systems 100 where maybe tens of sensors may be needed to disperse at different locations within the refrigeration system 100.

This disclosure contemplates an unconventional refrigerant leak detection system 200 and method that actively detects refrigerant leakage throughout the refrigeration system 100 as opposed to the current techniques where the system waits until the refrigerant passively reaches the sensor. In the disclosed system 200, a set of tubes 212 is positioned within the interior of the refrigeration system 100. Each tube 212 has holes on its surface to allow airflow to the interior of the tube 212. The fan 220 may be located at the end, within, outside, or at the edge of a tube 212. The sensor 230 is located downstream of the fan 220. When the fan 220 is switched on, it pulls the air from the inside of the tubes 212 toward the sensor 230. The air from the inside of the tubes 212 may include sampled air from the holes on the surface of the tubes 212. If there is a refrigerant leakage, air that is mixed with refrigerant particles is pulled into a hole on the tube 212 next to the leakage in response to the air pulling force from the fan 220. This causes that the sampled air (the mixture of the refrigerant particles and air) to be pulled toward the sensor 230. Therefore, the sensor 230 can detect the refrigerant leakage faster than conventional methods.

In this manner, the refrigerant leak detection system 200 improves the detection of refrigerant leakage from a component of the refrigeration system 100 by detecting the leakage faster than the conventional techniques, reducing the response time in detecting the leakage, and reducing the number of sensors required to detect leakage throughout the refrigeration system 100. For example, because the tubes 212 of the tubing system 210 run throughout the refrigeration system 100 and draw air from different locations within the refrigeration system 100, there is no need to deploy multiple sensors 230 within the refrigeration system 100.

Furthermore, in case water or other liquid droplets (as the result of defrost) accumulate within the refrigeration system 100 (e.g., as the result of defrost), the droplets will be dispersed or spread out inside the tubes 212 and will not reach the sensor 230. Thus, the sensor 230 is not damaged by the droplets. Thus, in this manner, the refrigerant leak detection system 200 improves the detection of refrigerant leakage from a component of the refrigeration system 100 by reducing the amount of water or other liquid droplets that are formed after defrost operation, where the droplets can reach the sensor and degrade the sensor.

Accordingly, the disclosed system 200 provides a practical application of improving the refrigerant leak detection by 1) reducing the refrigerant detection time and, therefore, the response time irrespective of the location of the leakage and the distance of the location of the leakage to the sensor compared to the current detection techniques; 2) reducing the number of sensor requirements for the refrigerant leak detection systems, especially in large refrigeration systems 100; 3) reducing the degradation to the sensors that occur due to water or other droplets that are typically carried to the sensors after defrost operations; and 4) initiating mitigation plans to address and remedy the refrigerant leakage faster than the current techniques, where the mitigation plans include switching on the blower of the refrigeration system, communicating an alert message that indicates the refrigerant leakage is detected, among others.

Tubing System

The tubing system 210 comprises a set of tubes 212 that are positioned adjacent to different components of a refrigeration system 100. As can be seen in FIG. 2, the tubes 212 are located longitudinally adjacent to various components of the refrigeration system 100. For example, some tubes 212 may be placed alongside components in which the refrigerant flows. In some examples, some tubes 212 may be placed adjacent to components where historically refrigerant leakage has occurred.

A tube 212 may be connected to another tube 212 from at least one place. For example, a first tube 212 may be connected to an adjacent tube 212 from one end or from a location along the length of the first tube 212. In this way, the tubes 212 may form interconnected tubes 212 where air can flow through the tubes 212. A connection between two tubes 212 may be in any suitable configuration. In the example of FIG. 2, the tubes 212 are shown to be connected to one another with a 90-degree bend. In other examples, the tubes 212 may be connected to one another with any suitable angle, such as the one shown in FIG. 7.

Figure 4:
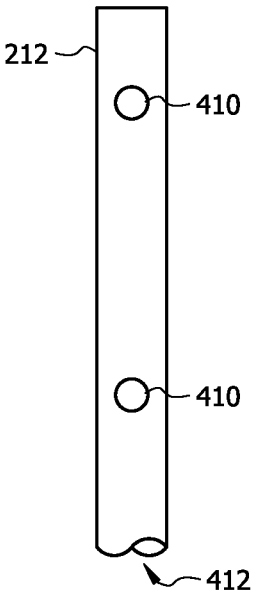
FIG. 4 illustrates an embodiment of a tube with holes on its surface and an opening on one end of the tube.

In some embodiments, the tubes 212 may be formed by a metal alloy, such as steel alloy, copper alloy, aluminum alloy, and the like. In some embodiments, the tubes 212 may be formed by a plastic alloy, such as Polyvinyl Chloride (PVC), Chlorinated Polyvinyl Chloride (CPVC), Polyethylene (PE), and the like. In some embodiments, the tubes 212 may be coupled together by welding, adhesive, joint covers, and the like. In some embodiments, the tubing system 210 may be formed as a single unified mesh of tubes 212, for example, by molding the tubes 212 in a casting iron frame process. The tube 212 may have any suitable shape. For example, the tube 212 may be a cylindrical tube with a half-inch radios. Each tube 212 may have a hollow interior to allow airflow through the tube 212. In some embodiments, each tube 212 may include holes on its surface to allow airflow between exterior and interior of the tube 212. Referring to FIG. 4, an embodiment of a tube 212 with holes 410 is illustrated. The holes 410 may be openings to draw in air samples to detect refrigerant leakage from a component of a refrigeration system 100. The holes 410 may be placed at periodic locations on the tube 212. For example, the holes 410 may be five inches apart, ten inches apart, and the like. The holes 410 may be placed next to the components of the refrigeration system 100. In some embodiments, a tube 212 may be closed at least on one end. For example, a tube 212 may have an opening 412 at least on one end. Such embodiments may allow the airflow thought the holes 410 on the surface of the tubes 212 to be stronger. In some embodiments, a tube 212 may be opened at both ends.

Figure 5:
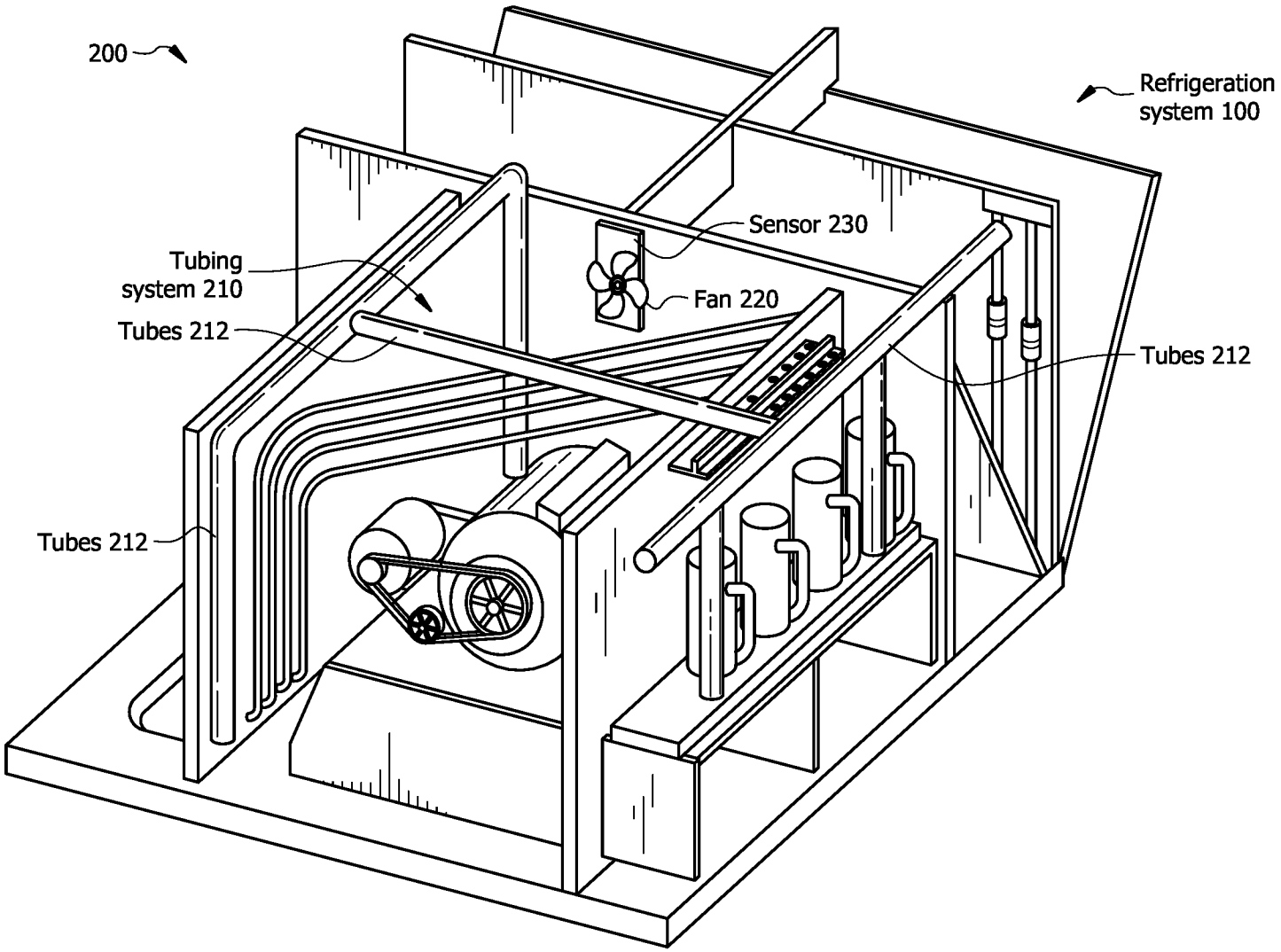
FIG. 5 illustrates an embodiment of a tubing system.
Figure 7:
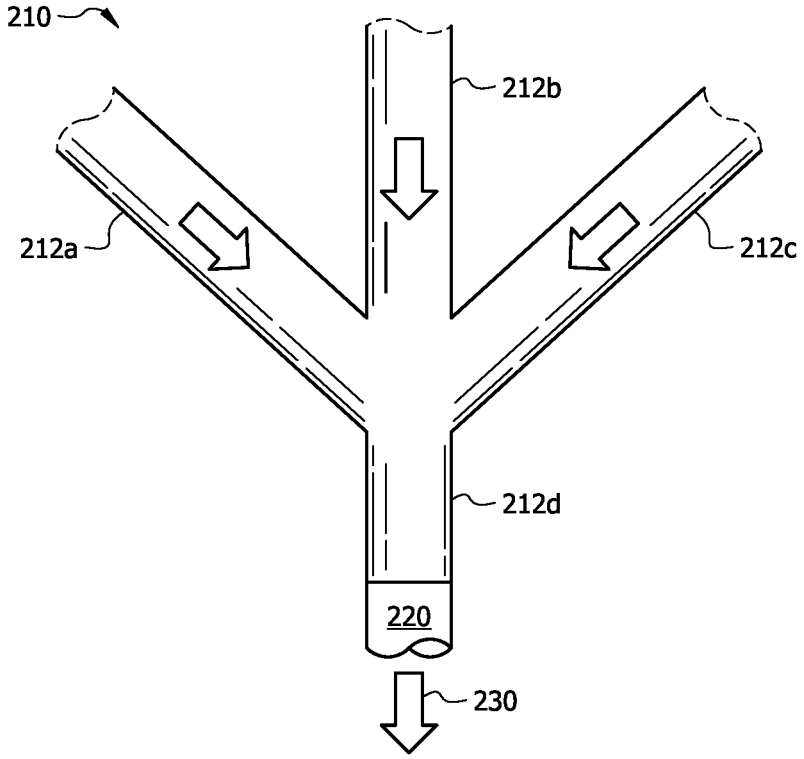
FIG. 7 illustrates an example embodiment of a tubing system.

Referring back to FIG. 2, the configuration of the tubing system 210 may be adapted to the structure of the refrigeration system 100. For example, the tubing system 210 may be designed to have tubes 212 running at any desired paths within a given refrigeration system 100. One example configuration of tubing system 210 is illustrated in FIG. 2, and other example configurations of tubing systems 210 are illustrated in FIGS. 5 and 7.

Fan

Fan 220 is generally any electronic and/or mechanical device that is configured to move air and create airflow, for example, when propellers of the fan 220 rotate. For example, the fan 220 may comprise rotating propellers or impellers that pull air and propel the air in a specific direction. In the example of FIG. 2, the fan 220 may be located downstream of the tubes 212. This is to draw in, pull air, or create airflow from inside of the tubes 212 toward the fan 220 and ultimately the sensor 230. In some embodiments, the fan 220 may be placed inside a tube 212.

Figure 6:
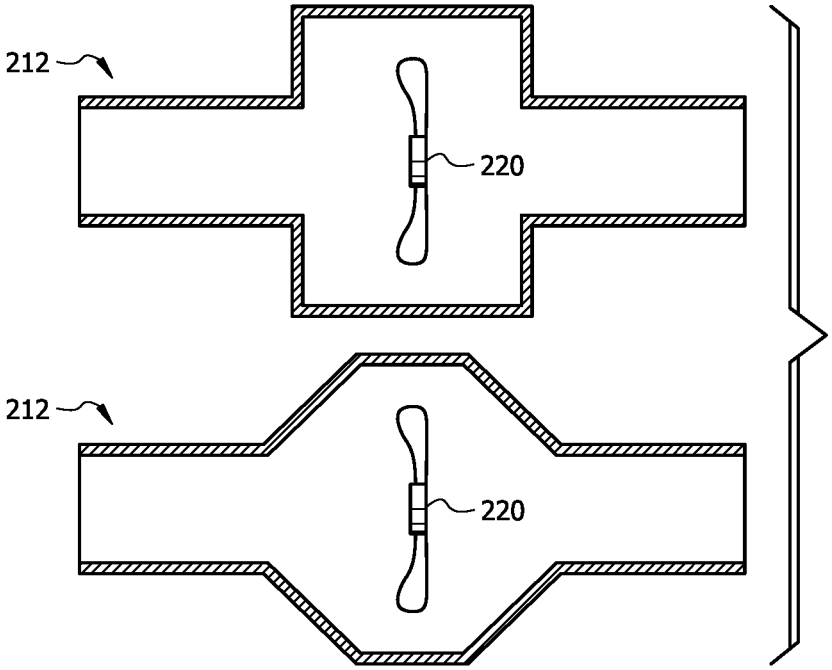
FIG. 6 illustrates example embodiments of housing of a fan within a tube.

Referring to FIG. 6, FIG. 6 illustrates example embodiments where the fan 220 is placed inside the tube 212. In some embodiments, the fan 220 may be placed at the edge of the tube 212. In some embodiments, the fan 220 may be placed outside of the tube 212. The fan 220 may be coupled to the tube 212, for example, by welding, adhesive, screws, and the like.

Referring back to FIG. 2, the fan 220 may be operably coupled to the controller 240 to draw power from the controller 240. For example, when it is desired to switch on the fan 220, the controller 240 may communicate a power signal to the fan 220 to switch on the fan 220. The fan 220 may be located upstream of the sensor 230 so the airflow drawn by the fan 220 can be directed to the sensor 230.

Sensor

Sensor 230 may be a sensor circuitry that is configured to detect refrigerant. For example, the sensor 230 may include a circuit board comprising electronic devices and is configured to detect refrigerant particles in the air and monitor the presence of refrigerant particles (e.g., refrigerant gases) in the air. In some examples, the sensor 230 may be a gas sensor configured to detect refrigerant particles in the air. In some examples, the sensor 230 may include a sensing element, such as transistors that when exposed to at least a threshold concentration of refrigerant particles in the air (e.g., threshold number of refrigerant particles per unit space volume 254) may detect the presence of the refrigerant particles. The sensor 230 may detect the refrigerant leak from the refrigerant particles in the air when more than a threshold number of refrigerant particles per unit space volume 254 (e.g., more than 50 particles per cubic inch, 40 particles per cubic inch, etc.) are present within the detection range of the sensor 230. The detection range of the sensor 230 may be five inches, ten inches, twenty inches, and the like.

When the fan 220 draws in sampled air from the holes in the tubes 212, the sampled air travel through the tubes 212 and toward the fan 220. The sensor 230 is placed downstream of the fan 220. Therefore, the sampled air is flown toward the sensor 230. If there is a refrigerant leak at a component of the refrigeration system 100, the refrigerant particles may be pulled into an adjacent hole on the tube 212 next to the refrigerant leak. In response, the sampled air from the hole may include refrigerant particles (and/or refrigerant) and air. The sampled air is drawn toward the fan 220 and the sensor 230. When the sampled air comes in within the detection range of the sensor 230 and include at least threshold number of refrigerant particles per unit space volume 254, the sensor 230 may detect the refrigerant leakage.

Controller

The controller 240 may correspond to the controller 138 described in FIG. 1. Aspects of the controller 240 are described in FIG. 1, and additional aspects are described in FIG. 2. The controller 240 may be a computing device that is configured to detect whether there is a refrigerant leakage at a component of the refrigeration system 100 and, in response to detecting that there is a refrigerant leakage, trigger a mitigation plan 256 associated with the refrigerant leakage. The controller 240 includes a processor 242 in signal communication with an Input/Output interface 244 and a memory 246. The components of the controller 240 are in signal communication with each other.

The processor 242 includes one or more processors operably coupled to the memory 246 and I/O interface 244. The processor 242 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 246 and controls the operation of refrigeration system 100. The processor 242 may be a programmable logic device, a microcontroller, a microprocessor, or any suitable combination of the preceding. The processor 242 is communicatively coupled to and in signal communication with the memory 246. The one or more processors are configured to process data and may be implemented in hardware or software. For example, the processor 242 may be 8-bit, 16-bit, 32-bit, 64-bit or of any other suitable architecture. The processor 242 may include an arithmetic logic unit (ALU) for performing arithmetic and logic operations, processor registers that supply operands to the ALU and store the results of ALU operations, and a control unit that fetches instructions from memory 246 and executes them by directing the coordinated operations of the ALU, registers, and other components. The processor 242 may include other hardware and software that operates to process information, control the refrigeration system 100, and perform any of the functions described herein (e.g., with respect to FIGS. 1-8). The processor 242 is not limited to a single processing device and may encompass multiple processing devices. Similarly, the controller 240 is not limited to a single controller but may encompass multiple controllers.

The I/O interface 244 is configured to communicate data and signals with other devices. For example, the I/O interface 244 may be configured to communicate electrical signals with components of the refrigeration system 100 including the sensor 230, among other components. The I/O interface 244 may be configured to communicate with other devices and systems. The I/O interface 244 may provide and/or receive, for example, compressor speed signals, compressor on/off signals, temperature signals, pressure signals, temperature setpoints, environmental conditions, and an operating mode status for the refrigeration system 100 and send electrical signals 250*a-b* to the components of the refrigeration system 100 and send alert signal 252 to administrators, technicians, or other users. The I/O interface 244 may include ports or terminals for establishing signal communications between the controller 240 and other devices. The I/O interface 244 may be configured to enable wired and/or wireless communications.

The memory 246 includes one or more disks, tape drives, or solid-state drives, and may be used as an over-flow data storage device, to store programs when such programs are selected for execution, and to store instructions and data that are read during program execution. The memory 246 may be volatile or non-volatile and may include ROM, RAM, ternary content-addressable memory (TCAM), dynamic random-access memory (DRAM), and static random-access memory (SRAM). The memory 246 is operable (e.g., or configured) to store information used by the controller 240 and/or any other logic and/or instructions for performing the function described in this disclosure. For example, the memory 246 may store instructions 248 for performing the functions of the controller 240 described in this disclosure. For example, when the instructions 248 are executed by the processor 242, the instructions 248 cause the processor 242 to perform one or more operations of the controller 240 described herein. The memory 246 may further store signals 250*a-b*, alert signal 252, threshold refrigerant particles per unit space volume 254, mitigation plans 256, and signals 258. These components are described further below in conjunction with the refrigerant leak detection operational flow.

Refrigerant Leak Detection Operational Flow

The operational flow for detecting refrigerant leakage may begin when the fan 220 is switched on. For example, the controller 240 may detect that a blower (blower 128 in FIG. 1) is turned off, and in response, communicate a signal 250*a* that causes the fan 220 to switch on to the fan 220. The controller 240 may also communicate a signal 250*b* to the sensor 230 that causes the sensor 230 to switch on. In the same or another example, the controller 240 may detect that the refrigeration system 100 is in service or switched off, and in response, communicate a signal 250*a* that causes the fan 220 to switch on to the fan 220. The controller 240 may also communicate a signal 250*b* to the sensor 230 that cause the sensor 230 to switch on. This operation may cause the air from the holes and openings of the tubes 212 to be drawn toward the fan 220 and the sensor 230.

When there is a refrigerant leakage at a component of the refrigeration system 100, the refrigerant and/or refrigerant particles may be pulled inside the holes adjacent to the refrigerant leakage and form a sampled air that comprises a mixture of air and refrigerant particles. The fan 220 pulls the sampled air through the tubing system 210 and direct the sampled air toward the sensor 230. The sensor 230 may detect the refrigerant particles in the sampled air when the sampled air includes at least the threshold number of refrigerant particles per unit space volume 254. In response, the sensor 230 may detect that the presence of the refrigerant and refrigerant leakage. The sensor 230 may communicate a signal 258 that indicates that the sampled air comprises a mixture of air and refrigerant particles to the controller 240. The signal 258 may also indicate that the sampled air includes at least the threshold number of refrigerant particles per unit space volume 254.

In response to receiving the signal 258, the controller 240 may determine that there is refrigerant leakage from at least one component of the refrigeration system 100. In response, the controller 240 may trigger the mitigation plan 256 associated with the refrigerant leakage. In some embodiments, the mitigation plan 256 may include switching on the blower 128 (see FIG. 1) of the refrigeration system 100, communicating an alert signal 252, where the alert signal 252 indicates that there is refrigerant leakage from at least one component of the refrigeration system 100. The alert signal 252 may be sent to computing devices of technicians, users, and administrators monitoring the refrigeration system 100.

Figure 3:
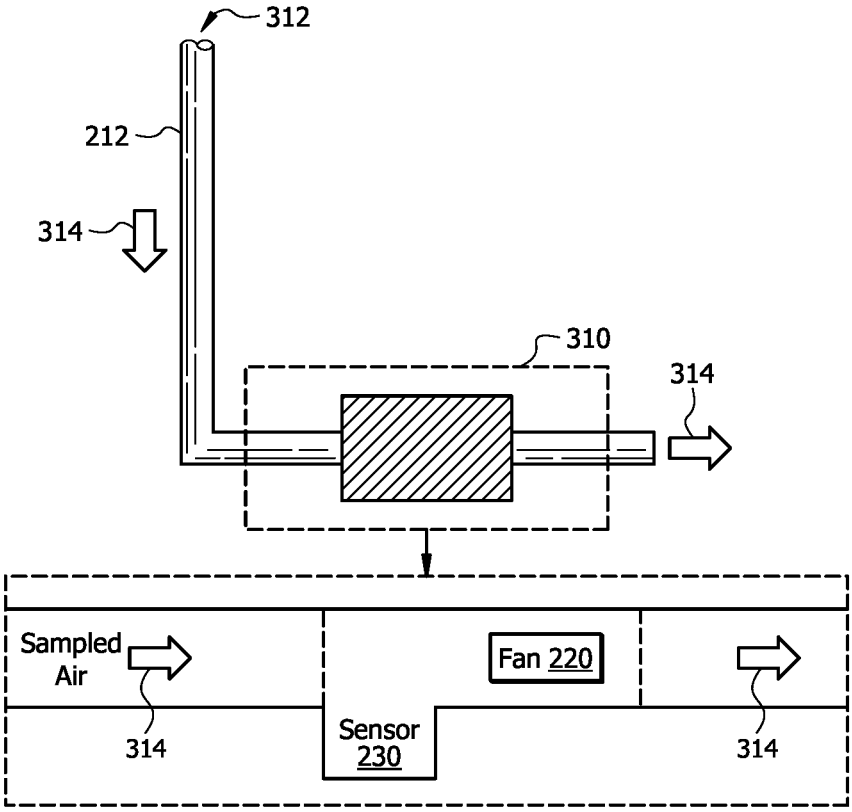
FIG. 3 illustrates example embodiments of a tube with a sensor and fan housing.

FIG. 3 illustrates an example embodiment of a tube 212 with a sensor and fan housing 310. In certain embodiments, the sensor 230 and fan 220 may be housed inside the sensor and fan housing 310. The sensor and fan housing 310 may be any structural component that is configured to house the sensor 230 and the fan 220. The sensor and fan housing 310 may be formed by a metal alloy or plastic alloy. When the fan 220 is switched on, it creates an airflow inside the tube 212 and the sampled air 314 flows toward the fan 220 and sensor 230. The airflow 314 may be coming from the opening 312 on the end of the tube 212 and/or from holes on the surface of the tube 212.

FIG. 4 illustrates an embodiment of a tube 212 with holes 410 on its surface and an opening 412 on one end of the tube 212. Aspects of holes 410 are described in the discussion of FIG. 2. The holes 410 may have any size and dimension. For example, each hole 410 may be a circle with a radios of 0.01 inches, 0.02 inches, and the like. FIG. 5 illustrates an embodiment of the system 200 where the tubing system 210 is adjusted to create interconnected tubes 212 throughout an example refrigeration system 100. The tubes 212 may be formed according to the locations of the components of the refrigeration system 100. FIG. 6 illustrates example embodiments of housing of the fan 220 within the tube 212. In some embodiments, the fan 220 may be housed in rectangular housing. In some embodiments, the fan 220 may be housed in a pentagon-shaped housing, or any other housing. In some embodiments, the fan 220 may be housed in a housing that extends from sides of the tube 212, for example, if the fan 220 is larger than the cross-section area of the tube 212. FIG. 7 illustrates an example embodiment of the tubing system 210. In the example of FIG. 7, three tubes 212*a-c* join together and connect to another tube 212*d* that leads to the fan 220 and sensor 230. In other examples, the tubing system 210 may take any suitable structure.

Example Method for Refrigerant Leak Detection

Figure 8:
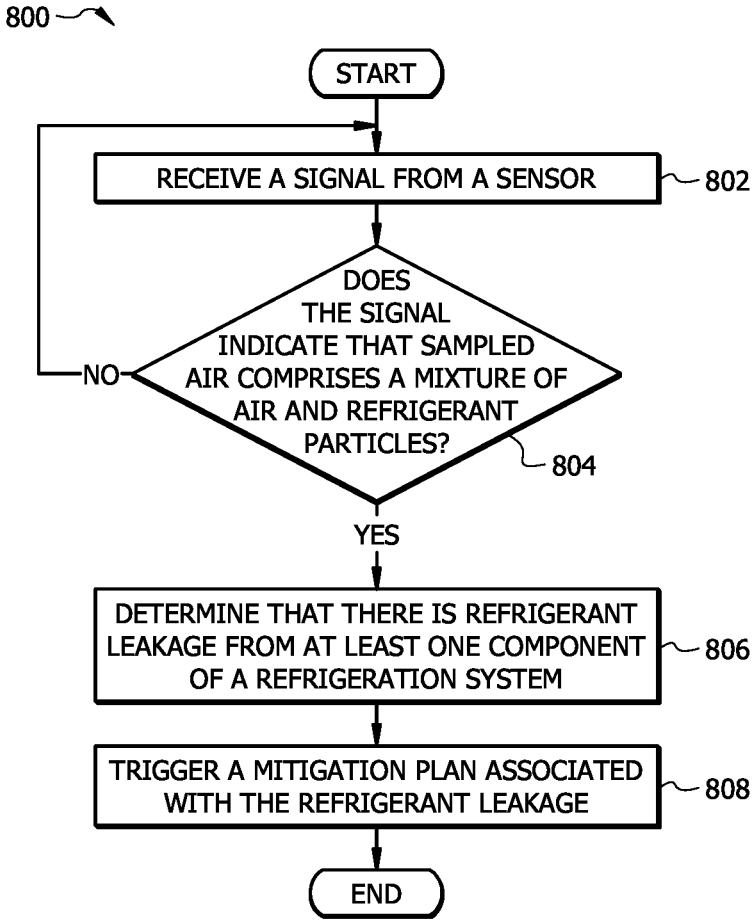
FIG. 8 illustrates a flowchart illustrating an example method for refrigerant leak detection used in the HVAC system of FIG. 1.

FIG. 8 illustrates an example method 800 of system 200 of FIG. 2 for detecting refrigerant detection. Modifications, additions, or omissions may be made to method 800. Method 800 may include more, fewer, or other operations. For example, operations may be performed in parallel or in any suitable order. While at times discussed as the system 100, system 200, controller 240, or components of any of thereof performing operations, any suitable system or components of the system may perform one or more operations of the method 800. For example, one or more operations of method 800 may be implemented, at least in part, in the form of software instructions 248 of FIG. 2, stored on non-transitory computer-readable media (e.g., memory 246 of FIG. 2) that when run by one or more processors (e.g., processor 242 of FIG. 2) may cause the one or more processors to perform operations 802-808.

At operation 802, the controller 240 receives a signal 258 from the sensor 230. The controller 240 may be communicatively coupled with the sensor 230 by wires or wirelessly. At operation 804, the controller 240 determines whether the signal 258 indicates that sampled air comprises a mixture of air and refrigerant particles. For example, the sampled air may the air pulled from the holes of the tubes 212 of the tubing system 210. If the controller 240 determines that the signal 258 indicates that sampled air comprises a mixture of air and refrigerant particles, method 800 proceeds to operation 806. Otherwise, method 800 returns to operation 802 to continue monitoring input from the sensor 230.

At operation 806, the controller 240 determines that there is refrigerant leakage from at least one component of the refrigeration system 100. For example, if the sampled air includes at least the threshold number of refrigerant particles per unit space volume 254, the controller 240 determines that there is refrigerant leakage from at least one component of the refrigeration system 100. At operation 808, the controller 240 triggers a mitigation plan 256 associated with the refrigerant leakage, similar to that described in FIG. 2.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A refrigeration system, comprising:

a tubing system that comprises one or more tubes, wherein:

the one or more tubes has one or more holes; and the one or more tubes is located adjacent to one or more components of the refrigeration system;

a sensor circuitry that is configured to detect refrigerant;

a fan that is located downstream of the one or more tubes, wherein the fan is configured to:

pull sampled air though the tubing system; and direct the sampled air toward the sensor circuitry, wherein the fan is further located upstream of the sensor circuitry; and a controller operably coupled to the sensor circuitry, and configured to:

receive, from the sensor circuitry, a signal that indicates that the sampled air comprises a mixture of air and refrigerant; and in response to receiving the signal:

determine that there is refrigerant leakage from at least one of the one or more components; and trigger a mitigation plan associated with the refrigerant leakage.

2. The system of claim 1, wherein determining that there is refrigerant leakage from at least one of the one or more components is in response to at least a portion of the refrigerant being exposed to a hole on a tube from among the one or more tubes.

3. The system of claim 1, wherein the mitigation plan comprises switching on a blower associated with the refrigeration system.

4. The system of claim 1, wherein the mitigation plan comprises communicating an alert signal, wherein the alert signal indicates that there is refrigerant leakage from at least one of the one or more components.

5. The system of claim 1, wherein the controller is further configured to:

detect that a blower of the refrigeration system is turned off; and in response to detecting that the blower of the refrigeration system is turned off:

communicate, to the fan, a signal that causes the fan to switch on; and communicate, to the sensor circuitry, a signal that causes the sensor circuitry to switch on.

6. The system of claim 1, wherein the controller is further configured to:

detect that the refrigeration system is in service; and in response to detecting that the refrigeration system is in service:

communicate, to the fan, a signal that causes the fan to switch on; and communicate, to the sensor circuitry, a signal that causes the sensor circuitry to switch on.

7. The system of claim 1, wherein the refrigerant is at least partially flammable.

8. A method, comprising:

pulling, by a fan, sampled air though a tubing system, wherein:

the tubing system comprises one or more tubes;

the fan is located downstream of the one or more tubes;

the one or more tubes has one or more holes; and the one or more tubes is located adjacent to one or more components of a refrigeration system;

directing, by the fan, the sampled air toward a sensor circuitry, wherein the fan is further located upstream of the sensor circuitry; and receiving, by a controller from the sensor circuitry, a signal that indicates that the sampled air comprises a mixture of air and refrigerant; and in response to receiving the signal:

determining, by the controller, that there is refrigerant leakage from at least one of the one or more components; and triggering, by the controller, a mitigation plan associated with the refrigerant leakage.

9. The method of claim 8, wherein determining that there is refrigerant leakage from at least one of the one or more components is in response to at least a portion of the refrigerant being exposed to a hole on a tube from among the one or more tubes.

10. The method of claim 8, wherein the mitigation plan comprises switching on a blower associated with the refrigeration system.

11. The method of claim 8, wherein the mitigation plan comprises communicating an alert signal, wherein the alert signal indicates that there is refrigerant leakage from at least one of the one or more components.

12. The method of claim 8, further comprising:

detecting that a blower of the refrigeration system is turned off; and in response to detecting that the blower of the refrigeration system is turned off:

communicating, to the fan, a signal that causes the fan to switch on; and communicating, to the sensor circuitry, a signal that causes the sensor circuitry to switch on.

13. The method of claim 8, further comprising:

detecting that the refrigeration system is in service; and in response to detecting that the refrigeration system is in service:

communicating, to the fan, a signal that causes the fan to switch on; and communicating, to the sensor circuitry, a signal that causes the sensor circuitry to switch on.

14. The method of claim 8, wherein the refrigerant is at least partially flammable.

15. A non-transitory computer-readable medium storing instructions that when executed by a processor, cause the processor to:

pull, via a fan, sampled air though a tubing system, wherein:

the tubing system comprises one or more tubes;

the fan is located downstream of the one or more tubes;

the one or more tubes has one or more holes; and the one or more tubes is located adjacent to one or more components of a refrigeration system;

direct, via the fan, the sampled air toward a sensor circuitry, wherein the fan is further located upstream of the sensor circuitry; and receive, by from the sensor circuitry, a signal that indicates that the sampled air comprises a mixture of air and refrigerant; and in response to receiving the signal:

determine that there is refrigerant leakage from at least one of the one or more components; and trigger a mitigation plan associated with the refrigerant leakage.

16. The non-transitory computer-readable medium of claim 15, wherein determining that there is refrigerant leakage from at least one of the one or more components is in response to at least a portion of the refrigerant being exposed to a hole on a tube from among the one or more tubes.

17. The non-transitory computer-readable medium of claim 15, wherein the mitigation plan comprises switching on a blower associated with the refrigeration system.

18. The non-transitory computer-readable medium of claim 15, wherein the mitigation plan comprises communicating an alert signal, wherein the alert signal indicates that there is refrigerant leakage from at least one of the one or more components.

19. The non-transitory computer-readable medium of claim 15, wherein the instructions further cause the processor to:

detect that a blower of the refrigeration system is turned off; and in response to detecting that the blower of the refrigeration system is turned off:

communicate, to the fan, a signal that causes the fan to switch on; and communicate, to the sensor circuitry, a signal that causes the sensor circuitry to switch on.

20. The non-transitory computer-readable medium of claim 15, wherein the one or more tubes is formed with a metal alloy or a plastic alloy.

* * * * *